United States Patent [19]

Musinski

[11] Patent Number: 4,660,625

[45] Date of Patent: Apr. 28, 1987

[54] HEAT TRANSPORT SYSTEM, METHOD AND MATERIAL

[75] Inventor: Donald L. Musinski, Saline, Mich.

[73] Assignee: KMS Fusion, Inc., Ann Arbor, Mich.

[21] Appl. No.: 568,216

[22] Filed: Dec. 30, 1983

[51] Int. Cl.[4] ..... F28D 15/00

[52] U.S. Cl. ..... 165/47; 165/104.14; 165/185; 165/104.33; 29/157.3 R

[58] Field of Search ..... 165/104.14, 47, 185, 165/104.33; 29/157.3 R

[56] References Cited

U.S. PATENT DOCUMENTS

| | | | |
|---|---|---|---|
| 1,786,285 | 12/1930 | Bissell | 165/185 |
| 3,013,104 | 12/1961 | Young | 165/185 |
| 3,481,439 | 12/1969 | Finkin | 165/47 |
| 3,596,713 | 8/1971 | Katz | 165/104.17 |
| 3,640,517 | 2/1972 | Sendt | 165/47 |
| 3,913,666 | 10/1975 | Bayliss | 165/185 |
| 4,212,349 | 7/1980 | Andros et al. | 165/104.26 |

FOREIGN PATENT DOCUMENTS

| | | | |
|---|---|---|---|
| 2443144 | 3/1976 | Fed. Rep. of Germany | 165/47 |
| 32863 | 3/1979 | Japan | 165/104.17 |
| 27890 | 3/1981 | Japan | 165/104.17 |

*Primary Examiner*—Albert W. Davis, Jr.
*Attorney, Agent, or Firm*—Barnes, Kisselle, Raisch, Choate, Whittemore & Hulbert

[57] ABSTRACT

A heat transport system, method and composite material in which a plurality of hollow spherical shells or microspheres having an outside diameter of less than or equal to 500 microns are encapsulated or embedded within a bulk material. Each shell has captured therein a volatile working fluid, such that each shell operates as a microsized heat pipe for conducting heat through the composite structure.

20 Claims, 1 Drawing Figure

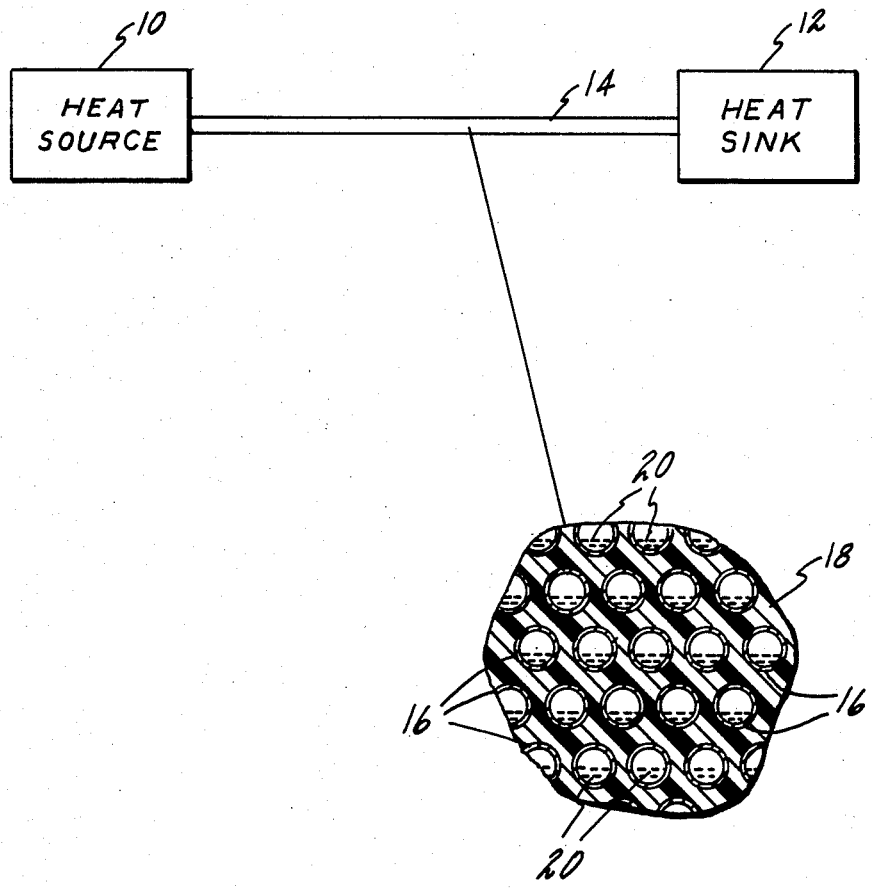
10
HEAT SOURCE
14
12
HEAT SINK
20
18
16
16
20

HEAT TRANSPORT SYSTEM, METHOD AND MATERIAL

The Government has rights in this invention pursuant to Contract No. DE-AC08-82DP40152 awarded by the U.S. Department of Energy.

The present invention is directed to heat transport systems, methods and materials, and more particularly to a technique for increasing thermal conductivity of bulk materials such as plastics and resins.

A general object of the present invention is to provide a system and method for enhancing thermal conductivity of bulk materials, such as plastics and resins. A related object of the invention is to provide a composite heat conductive material which embodies such system and method, and a method of constructing such a material.

A more specific object of the invention is to provide a technique for increasing thermal conductivity of electrical integrated circuit packages, thereby increasing circuit reliability and providing opportunity for increasing circuit density.

The invention, together with additional objects, features and advantages thereof, will be best understood from the following description, the appended claims and the accompanying drawing which is a schematic illustration of the heat transport system and method of the invention.

The drawing is a schematic illustration of a heat transport system comprising a heat source 10 and a heat sink 12 interconnected by a thermal conductor 14. In the case of integrated circuit technology, heat source 10 would be the circuit itself, heat sink 12 may be air circulated within a cabinet or enclosure, and conductor 14 would comprise the metal leads of the circuit and the epoxy or plastic circuit case. The thermal path through the leads is limited by the size of the thin metallic wires which connect the chip to the output legs. Thus, a major path for heat dissipation is through the case, which is presently limited by the basic properties of case materials used in the industry—primarily plastic and epoxy.

In accordance with the present invention, thermal conductor 14 comprises a multiplicity of hollow spherical shells or microspheres 16 carried as a filler in the bulk material 18 of conductor 14. Each shell 16 contains a volatile working fluid 20, shown in liquid phase in the drawing. Shells 16 may be of metal, plastic or glass (including ceramic) composition, or other suitable composition as dictated by secondary consideration of a specific application. Shells 16 in accordance with the invention have an outside diameter that is limited only by the basic properties, i.e. surface tension, of the working fluid 20, and may be formed using any suitable conventional technique. U.S. Pat. Nos. 4,017,290, 4,021,253, 4,336,338 and 4,340,407 disclose various suitable methods and apparatuses for forming the glass shells that may be preferred for specific applications. See also U.S. Pat. Nos. 4,133,854, 4,163,637 and 4,257,799. U.S. Pat. Nos. 2,797,201 and 4,327,192 disclose suitable techniques for forming hollow plastic shells. U.S. Pat. No. 3,953,617 discloses techniques for forming hollow metal shells. Working fluid 20 may be of any suitable composition. For use in conjunction with glass shells in integrated circuit applications in the temperature range of 50° C. to 150° C., water with or without a wetting agent is suitable.

Working fluid 20 is placed in shells 16 prior to encapsulation of the shells within bulk material 18. This is preferably accomplished in accordance with the technique disclosed in U.S. application Ser. No. 675,530 filed Apr. 9, 1976 and assigned to the assignee hereof, now U.S. Pat No. 4,432,933. Briefly stated, this technique contemplates placement of a quantity of preformed shells in an atmosphere of working fluid vapor at elevated temperature and pressure, less than the softening temperature of the shell material, for a period of time sufficient to permit permeation of the vapor through the shell walls and into the hollow shell interior. Temperature and pressure are thereafter decreased effectively to entrap the working fluid within the shell. Other methods for precharging the shells may also be employed. It is also within the scope of the invention to charge the shells in or as part of the shellforming operation, i.e. to form the shells so as to encapsulate the working fluid following the formation process.

The charged shells are then placed in the bulk material prior to hardening of the latter. For example, in applications for integrated circuits having various plastic cases, shells 16 of suitable material such as silicate glass construction may have diameters in the range of 50 μm to 500 μm and a wall thickness of less than 1 μm to 5 μm. Fluid 20, in liquid phase, may be in the amount sufficient to cover or wet the inside surface of each shell at the maximum operating temperature, and thus fill only a very small portion of the internal shell volume. The charged shells are suspended in the plastic case material while the latter is fluid, and the case material is then suitably molded and cured. In the final product or circuit case, shells 16 with internal fluid may fill or comprise up to approximately 60% of the total case volume, the remainder being of bulk material 18. It will be appreciated, of course, that bulk material 18 may be of other than plastic construction where conditions require, such as when maximum heat conduction capacity requires that bulk material 18 (and perhaps shells 16) be of metallic construction.

In operation, each microsphere or shell 16 operates as a micro-sized heat or vapor pipe. The working fluid evaporates along that portion of the internal shell surface proximate to the heat source, migrates across the internal shell cavity, condenses on the opposing portion of the shell surface, and then flows along the shell wall back to the first surface portion. Heat thus transferred is conducted through the surrounding bulk material to the next shell, and so forth to the heat sink. The rate of heat transport within each shell is equal to the heat of vaporization of the working fluid times the rate of mass transport. Thermal conductivity of the walls of shells 16 and of the bulk material 18 limit overall heat transport efficiency. It is, of course, important that bulk material 18 be in intimate heat transfer contact with the outer shell surfaces.

It is also important that the composition of shell 16 and of working fluid 20 be selected such that fluid 20 remains sealed and captured within shell 16 under expected operating conditions, which is to say that shell and fluid composition are to be selected such that no substantial amount of fluid permeates through the shell wall in the vapor phase. The heat of vaporization of the working fluid and the maximum expected operating temperature should also be well below the softening temperatures of the shell and bulk material.

It may be desirable in some applications to provide differing working fluids 20 within the various shells 16.

The various fluids may have differing vaporization temperatures. It would then be possible to control thermal conductivity of conductor 14 as a function of temperature by controlling the quality of each shell/fluid type used in forming the conductor composite material.

The invention claimed is:

1. A heat transport system for conducting thermal energy between a heat source and a heat sink comprising bulk material means extending between said heat source and said heat sink, a multiplicity of hollow spherical shells having an outside diameter of less than or equal to 500 microns contained within said bulk material means, with said bulk material means being in heat transfer contact with outer surfaces of said shells, and a volatile working fluid captured within each of said shells, diameter of said shells being coordinated with surface tension of said fluid such that thermal energy is transported across each said shell evaporation at one internal surface of said shell proximate to said heat source, migration of fluid vapor across the internal cavity of said shell, condensation at the opposing shell surface proximate to said heat sink and flow of said fluid along the internal shell wall surface back to said first surface portion.

2. The system set forth in claim 1 wherein said shells are constructed of material selected from the group consisting of glasses, plastics and metals.

3. The system set forth in claim 1 wherein said shells are of silicate glass construction.

4. The system set forth in claim 1 wherein said working fluid comprises water.

5. A heat transport system for conducting thermal energy between a heat source and a heat sink within a predetermined temperature range, said system comprising a bulk material of solid phase construction within said temperature range, a plurality of hollow spherical shells encapsulated within said bulk material and in heat transfer contact with said bulk material around the outside surfaces of said shells, said shells being constructed of material having a softening temperature above said temperature range and having an outside diameter less than or equal to 500 microns, and a working fluid captured within each of said shells and having a volatilization temperature within said range, said working fluid being substantially impermeable through said shell material within said temperature range.

6. The system set forth in claim 5 wherein said shells have a diameter in the range of 50 to 500 microns and a wall thickness in the range of 1 to 5 microns.

7. A method of transporting heat energy from a heat source to a heat sink comprising the steps of:

(a) locating a bulk material between said heat source and said heat sink, said bulk material having a multiplicity of internally contained cavities having an outside diameter of less than or equal to 500 microns sealed from each other, and (b) placing a volatile working fluid into each of said cavities.

8. A method of constructing a heat conductive composite material comprising the steps of:

(a) providing a multiplicity of hollow spherical shells having an outside diameter of less than or equal to 500 microns each having a volatile working fluid encapsulated therein, and (b) encapsulating said shells within a solid phase bulk material such that said bulk material is in heat transfer contact with and between said. shells.

9. The method set forth in claim 8 wherein said shells are constructed of material selected from the group consisting of glasses, plastics and metals.

10. The method set forth in claim 9 wherein said shells are of silicate glass construction.

11. The method set forth in claim 10 wherein said working fluid comprises water.

12. The method set forth in claim 11 wherein said bulk material is of plastic construction.

13. The method set forth in claim 8 wherein said step (a) comprises the steps of providing preformed shells, placing said shells in an atmosphere of said working fluid in vapor phase at elevated temperature and pressure for a time sufficient to permit permeation of said vapor phase through the walls of said shells into the hollow interior of said shells, and then decreasing temperature and pressure until said working fluid is substantially impermeable through said shell walls.

14. A heat conductive composite material consisting essentially of a bulk material, means forming a multiplicity of spherical internal cavities having an outside diameter of less than or equal to 500 microns within said material, said cavities being spaced from and sealed from each other, and a volatile working fluid disposed within each of said cavities and substantially impermeable through said means.

15. The composite material set forth in claim 14 wherein said means comprises structure distinct from said bulk material.

16. The composite material set forth in claim 15 wherein said means comprise a multiplicity of hollow spherical shells.

17. The composite material set forth in claim 16 wherein said shells are constructed of material selected from the group consisting of glasses, plastics and metals.

18. The composite material set forth in claim 17 wherein said shells are of silicate glass construction.

19. The composite material set forth in claim 18 wherein said working fluid comprises water.

20. The composite material set forth in claim 14 wherein said bulk material is of plastic construction.

* * * * *